United States Patent [19]

Blass et al.

[11] Patent Number: 4,537,566

[45] Date of Patent: Aug. 27, 1985

[54] VALVE ASSEMBLY FOR A COMPRESSOR

[75] Inventors: Jaroslav Blass; Michael A. Deal, both of Sidney, Ohio

[73] Assignee: Copeland Corporation, Sidney, Ohio

[21] Appl. No.: 609,098

[22] Filed: May 10, 1984

[51] Int. Cl.[3] ..... F04B 39/10; F16K 15/14

[52] U.S. Cl. ..... 417/569; 137/517; 137/851

[58] Field of Search ..... 417/559, 565, 566, 569–571; 137/517, 851

[56] References Cited

U.S. PATENT DOCUMENTS

| | | | |
|---|---|---|---|
| Re. 15,472 | 10/1922 | Riesner | 137/851 |
| 1,029,726 | 6/1912 | Sprado | 137/517 |
| 1,402,082 | 1/1922 | Moran | 137/851 |
| 1,417,690 | 5/1922 | Riesner | 137/851 |
| 1,911,939 | 5/1933 | Belyavin | 137/851 X |
| 2,086,630 | 7/1937 | Miner . | |
| 2,195,292 | 3/1940 | Albertson | 137/851 |
| 2,223,944 | 12/1940 | Roy | 137/517 |
| 2,243,123 | 5/1941 | Ritter | 137/851 X |
| 2,434,734 | 1/1948 | Buschmann | 417/565 |
| 2,579,661 | 12/1951 | Freund . | |
| 2,864,394 | 12/1958 | Hempel | 137/517 |
| 2,908,109 | 10/1959 | Rotwein | 137/517 X |
| 3,109,451 | 11/1963 | Mihalakis | 137/517 X |
| 3,192,913 | 7/1965 | Rice | 137/517 X |
| 4,345,428 | 8/1982 | Cook | 137/517 X |

FOREIGN PATENT DOCUMENTS

| | | | |
|---|---|---|---|
| 2640054 | 3/1978 | Fed. Rep. of Germany | 417/565 |
| 1217652 | 12/1959 | France | 137/517 |
| 636410 | 3/1962 | Italy | 417/565 |
| 371688 | 4/1932 | United Kingdom | 417/565 |

*Primary Examiner*—William L. Freeh
*Assistant Examiner*—Paul F. Neils
*Attorney, Agent, or Firm*—Harness, Dickey & Pierce

[57] ABSTRACT

An improved valve plate assembly is disclosed herein which is particularly well suited for use in compressors and particularly refrigeration compressors employing pressure responsive reed type valving. The present invention provides several arrangements whereby the velocity of valve member may be reduced as it moves into a closed position so as to substantially reduce the resulting noise generated therefrom.

7 Claims, 6 Drawing Figures

VALVE ASSEMBLY FOR A COMPRESSOR

BACKGROUND AND SUMMARY OF THE INVENTION

The present invention relates generally to compressors and more particularly to valve assemblies for use in such compressors.

Various types of reed valves are commonly employed in compressors for controlling the flow of gas to and from the compression chamber. Typically such valve arrangements comprise an elongated relatively thin resilient valve member positioned so as to overlie and selectively close off passageways provided in a valve plate assembly. In typical reciprocating piston type compressors such reed type valve members are commonly mounted in engaging sealing relationship with the valve plate forming one end of the compression chamber and are operated by the pressure differential created by the reciprocating piston.

While such valving arrangements have provided extremely reliable efficient operation over a long period of time, there have arisen applications wherein the noise resulting from the closing slap of the valve member against the valve plate as it moves into a closed position is sufficient to become objectionable.

Accordingly, the present invention provides a means by which this source of potentially objectionable noise may be significantly reduced at relatively low cost and without substantially affecting the overall operating efficiency of the compressor. It has been discovered that by positioning that portion of the valve member which experiences the greatest range of movement in a sightly spaced relationship with respect to the associated valve plate when the valve member is in an at rest condition, significant reduction in the noise level emanating from the compressor is achieved. It appears that this reduction in noise level is due to the substantially lower velocity of the valve member as it moves into the fully closed position. In one embodiment, the valve member is biased into this slightly open position by means of spring generated moments exerted on opposite ends thereof. In another form a resilient member may be employed or alternatively a fixed ramp provided to exert a moment on one or both ends of the reed valve. In yet another embodiment the valve member itself is formed with a slight arcuate bow extending over the length thereof.

Additional advantages and features of the present invention will become apparent from the subsequent description and the appended claims taken in conjunction with the accompanying drawings.

DESCRIPTION OF THE PREFERRED EMBODIMENTS

Figure 1:
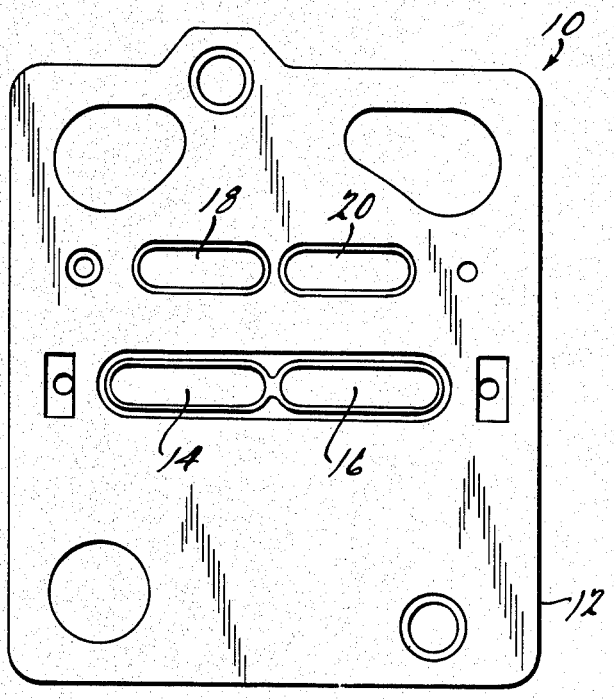
FIG. 1 is a plan view of a valve plate for use in conjunction with the present invention as seen from the compression chamber side thereof.
Figure 3:
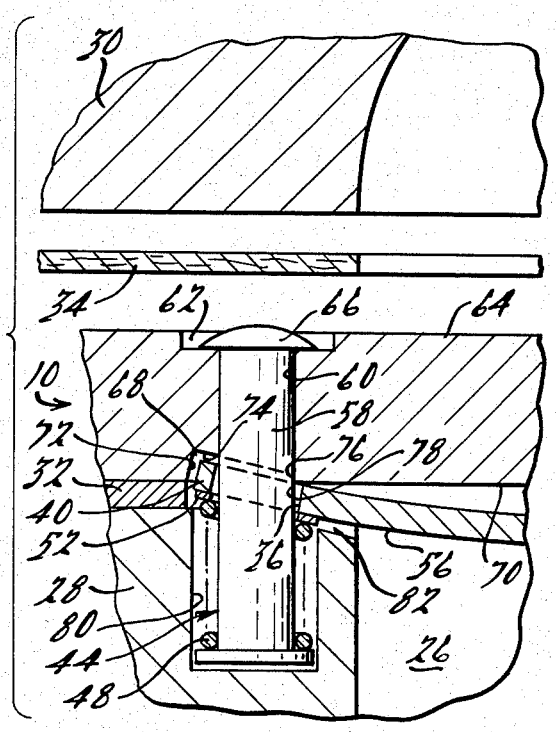
FIG. 3 is a fragmentary exploded section view of the present invention showing the valve plate in operative relationship to a compressor housing with the associated head and head gasket about to be installed thereon.
Figure 2:
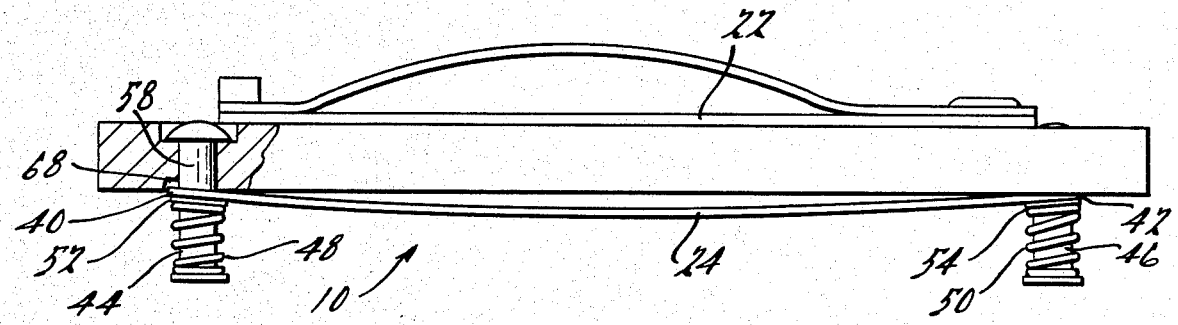
FIG. 2 is a side elevational view of the present invention with portions broken away therefrom and showing the valve plate of FIG. 1 with the valve member in assemblied relationship therewith.

Referring now to the drawings and in particular to FIGS. 1 through 3, there is shown a valve plate assembly 10 in accordance with the present invention which is specifically designed for use in conjunction with refrigeration compressors such as of the type disclosed in assignee's copending application Ser. No. 516,904 filed July 25, 1983 entitled "Hermetic Refrigeration Compressor" for example, the disclosure of which is hereby incorporated by reference.

As shown valve assembly 10 comprises a generally rectangularly shaped plate member 12 having a pair of elongated generally oval shaped suction passsges 14 and 16 extending therethrough positioned in spaced end to end relationship. A pair of similarly shaped discharge gas passages 18 and 20 are also provided being spaced laterally adjacent to the suction passages 14 and 16 and in spaced end to end relationship with respect to each other. Elongated reed type discharge and suction valve members 22 and 24 are provided on valve assembly 10 which are designed to selectively control the flow of refrigerant through respective discharge and suction gas passages.

As illustrated in FIG. 3, valve assembly 10 is designed to be positioned in overlying relationship to a compressor cylinder 26 provided in housing 28 and clamped thereagainst by means of a head 30 with suitable gasket means 32 and 34 provided on opposite sides thereof.

As mentioned previously, one source of noise emanating from refrigeration compressors has been found to be the valve members closing against the valve plate. In order to reduce the noise generated by this source the present invention in the preferred embodiment provides means for exerting a moment on the valve member adjacent one end thereof which operates to position a portion overlying the suction passageway in a sightly spaced relationship to the valve plate when the valve member is in an at rest condition. In this manner, movement of the suction valve to the closed position is arrested or at least substantially reduced in speed just prior to its contacting of the valve plate and hence the resulting noise generated thereby is reduced.

In one preferred form as shown in FIGS. 2 and 3, the suction valve 24 is in the form of an elongated reed valve having slotted openings 36 adjacent opposite ends 40, 42 thereof which are designed to accommodate preheaded locating pins 44, 46. Each of the pins carries a helical coil compression spring thereon 48, 50, one end of which is seated against the preformed head and the other end of which bears against a wear washer 52, 54 which in turn is urged against the lower surface 56 of the valve member 24. The shank portion 58 of the pin is inserted through an opening 60 in the valve plate into a recess 62 provided in the upper surface 64 of the valve plate and is thereafter deformed in a suitable manner to form a head 66 thereon so as to retain the valve plate 12, valve 24, spring 48 and pin 44 in assembled relationship. Preferably the height of the head 66 of each of the pins 44, 46 will be controlled with respect to the depth of the recesses 62 so as to insure they will be equal to or project slightly above a plane defined by the upper surface 64 of the valve plate 12 whereby the head 30 and head gasket 34 may exert a downwardly directed force thereon and thereby operate to prevent upward movement of the pins 44 and 46 during operation of the compressor.

As best seen with reference to FIG. 3, a relatively small notch 68 is provided in the lower surface 70 (as shown) of the valve plate 12. Notch 68 is defined by a pair of inclined sidewalls 72, 74 disposed at substantially right angles with respect to each other and inclined with respect to the lower surface 70 of the valve plate 12. The inner wall 74 terminates at a relatively small step wall portion 76 at its edge closest to the compression chamber defined by the cylindeer 26, the step wall portion 76 being positioned substantially perpendicularly with respect to the lower surface 70 of the valve plate 12 and defining a fulcrum point 78 at its intersection therewith. The provision of this step wall portion 76 assures that the location of this fulcrum point 78 will not change during final surface grinding and/or finishing of the lower surface 70 of the valve plate 12 as may occur were wall portion to intersect surface 70 at an angle other than substantially 90°.

A bore 80 is provided in the compressor housing 28 to accommodate the lower end of the pin 44 and the associated spring 48. Bore 80 opens into a notched portion 82 which is designed to accommodate the end portion 40 of the valve member 24. A structural arrangement substantially idential to that described above will also be provided at the other end 42 of valve member 24 in conjunction with and to accommodate pin 46, spring 50 and wear washer 54.

In operation, coil springs 48 and 50 will exert an upwardly directed (as shown) biasing force adjacent the end portions 40 and 42 respectively of the reed valve 24 which will both urge the valve member 24 into engagement with and tend to flex it slightly about fulcrum points 78. Because the biasing action of the coil spring may be considered as acting at the point of intersection of its axis with the plane of the valve member, there will be a moment arm approximately equal to the distance between the center of the pin and fulcrum point 78. The force and resulting moment exerted on the valve member 24 will both maintain the valve member in engagement with the fulcrum point 78 as well as cause the valve member to assume a slightly arcuate shape with the center portion of the valve member bowing out slightly in the area overlying the suction passageways 14, 16 in the valve plate 24 when the valve is in a static at rest condition, In the particular arrangement illustrated it has been found that a spring force of approximately 3–4 pounds acting through the illustrated moment arm results in maximum spacing of valve member 24 from surface 70 of valve plate 12 of approximately 0.030 inch which produces the desired significant decrease in the compressor noise level with only a small fraction of a percent decrease in operating efficiency. It should be noted, however, that it may be possible to achieve comparable or other desired results by locating the fulcrum point 78 at another position and/or altering the force exerted by the spring and hence the resulting moment.

As the compressor operates, the suction stroke of the piston (not shown) within the cylinder 26 will create a suction pressure within the cylinder thereby moving the suction valve 24 into a greater bowed open condition whereby suction gas may be drawn into the cylinder through passages 14, 16. As the suction stroke is completed, the pressure differential on the valve member 24 will decrease rapidly and the valve member 24 will begin a relatively rapid movement toward a closed position. However, because of the moment exerted on the end portions 40 and 42 thereof the valve member will not fully close but rather will remain in a slightly open position once the actuating pressure differential has subsided. As the piston begins to move through its compression stroke, the increasing pressure within the cylinder will operate to force the section valve 24 against surface 70 of valve plate 24 and hence into a fully closed position. Thus, the suction valve 24 is prevented from moving into a fully closed engagement with the valve plate 12 at a high rate of speed by the moment exerted thereon and the resulting noise associated therewith is substantially reduced.

Figure 4:
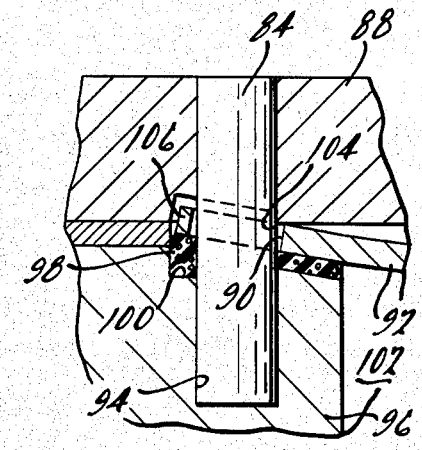
FIG. 4 is a view similar to that of FIG. 3 but showing another embodiment of the present invention.

An alternative means for exerting this moment on the valve member is illustrated in FIG. 4. As shown therein, a locating pin 84 of generally elongated cylindrical shape is provided which extends through an opening 86 in valve plate 88, through a slotted opening 90 in the valve member 92 and into a bore 94 in the compressor housing 96. In this embodiment, the moment or biasing action is created by means of a suitable resilient wedge shaped insert 98 positioned within the recess 100 provided in the sidewall of the cylinder 102. The insert 98 may be fabricated from any suitable material and will be sized so as to create both the desired preloading of the valve member against the fulcrum point 104 as well as the desired moment on the end portion 106 of the valve member 92. The operation and function of the resilient member 98 and associated valve member 92 will otherwise be substantially identical to that described above with reference to the preferred embodiment of FIGS. 1–3.

Figure 5:
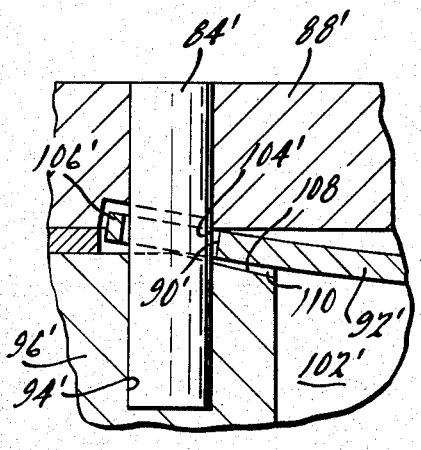
FIG. 5 is also a view similar to that of FIG. 4 but illustrating yet another embodiment of the present invention.

Another embodiment is shown in FIG. 5 which is similar in construction to the embodiment of FIG. 4 and thus like portions are indicated by like numbers primed. However, in this embodiment the resilient biasing member 98 is replaced by suitably inclining and contouring the inner (or lower as shown) wall portion 108 of notch 110 so as to create the desired moment on the end portion 106′ of the valve member 92′. Again the operation is substaintally identical to that described above.

Figure 6:
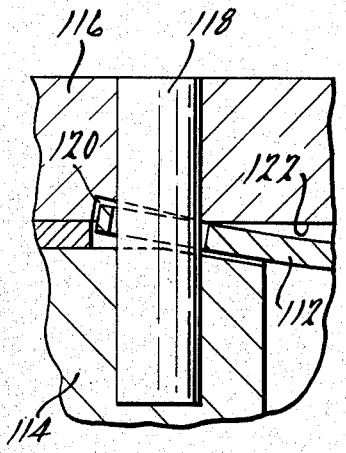
FIG. 6 is another view similar to that of FIG. 3 but showing yet another embodiment.

Referring now to FIG. 6 there is shown yet another embodiment of the present invention. In this embodiment valve member 112 is formed with a generally smooth arcuate shape extending substantially over its entire length as opposed to being bowed by exertion of a moment on the end portions thereof. As shown in FIG. 6 valve member 112 is mounted between compressor housing 114 and valve plate member 116 in a conventional manner with locating pin 118 extending therethrough. Because valve member 112 is prebowed as formed, there is no need for an accurately positioned fulcrum point and hence notch 120 in lower surface 122 of valve plate 116 is provided only to accommodate upward tilting movement of the end of the valve member as it moves into an open position. The operation of this embodiment is again substantially identical to that described above as the preformed bow operates to slightly space the central portion of valve member 112 from the valve plate 116.

It should also be noted that while the present invention has been illustrated and described in conjunction with reed type suction valves extending diametrically or chordally across the cylinder and with substantially identical moment exerting means provided at both ends thereof, it may also be utilized in conjunction with reed valves extending only partially across the cylinder by merely providing the moment force at the secured end thereof or suitably preforming the valve member. Similarly, in some applications wherein both ends of the reed valve are secured, it may be desirable to provide a moment exerting means at only one end thereof. Further, while the present invention has been illustrated in conjunction with suction valves only, it may also be applicable in some applications to discharge valves.

In any event the present invention provides a relatively inexpensive and unique means by which the noise generated by the valve action may be substantially reduced by inhibiting or preventing the slapping action commonly attendant with reed type valve members.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A valve assembly for a compressor comprising:

a valve plate having a gas passage extending therethrough;

an elongated valve member having a portion overlying said passage and operative to selectively control flow of gas therethrough;

resilient biasing means acting on said valve member adjacent said one end for exerting a moment on said valve member adjacent one end thereof, said moment being operative to normally position said portion in slightly spaced relationship to said valve plate when said valve member is in an at rest position; and fastener means extending from said valve plate for retaining said biasing means and said valve member in assembled relationship with said valve plate.

2. A valve assembly as set forth in claim 1 wherein said resilient biasing means comprise a helical coil spring.

3. A valve assembly as set forth in claim 1 wherein said valve plate assembly is secured between a head and a compressor housing in overlying relationship to a compression chamber, said fastener having an end positioned equal to or slightly above the surface of said valve plate facing said head whereby said head and an associated sealing means may operate to inhibit relative movement of said fastener means.

4. A valve assembly for a compressor comprising:

a valve plate having a gas passage extending therethrough;

an elongated valve member having a portion overlying said passage and operative to selectively control flow of gas therethrough; and a fulcrum point on said valve plate engaging said valve member and biasing means acting against said valve member between said fulcrum point and said one end for exerting a moment on said valve member adjacent one end thereof, said moment being operative to normally position said portion in slightly spaced relationship to said valve plate when said valve member is in an at rest position.

5. A valve assembly as set forth in claim 4 wherein said biasing means further operates to exert a preloading on said valve member operative to maintain its engagement with said fulcrum point.

6. A valve assembly as set forth in claim 4 wherein said resilient biasing means comprise a helical coil spring.

7. A valve assembly for a compressor comprising:

a valve plate adapted to be secured in overlying relationship to a compression chamber and including passage means for conducting fluid to or from said compression chamber;

an elongated pressure actuated reed valve means extending across said compression chamber and positioned in overlying relationship to said passage means, said valve means being movable from an open position to a closed position wherein said valve means sealingly engages said valve plate so as to substantially prevent flow of fluid through said passage; and biasing means adjacent opposite ends of said valve means to exert moments thereon whereby a center portion thereof is biased into a slightly spaced relationship with respect to said valve plate so as to thereby provide a slight resistance to movement of said valve member into said closed position whereby the noise generated by engagement of said valve member with said valve plate is substantially reduced.

* * * * *